United States Patent [19]

Wolf et al.

[11] 4,107,445

[45] Aug. 15, 1978

[54] TITANIUM AND ZIRCONIUM PRODUCTION BY ARC HEATER

[75] Inventors: Charles B. Wolf, Irwin; Maurice G. Fey, Plum Borough, both of Pa.

[73] Assignee: Westinghouse Electric Corp., Pittsburgh, Pa.

[21] Appl. No.: 745,726

[22] Filed: Nov. 26, 1976

[51] Int. Cl.[2] ..... H05H 1/00

[52] U.S. Cl. ..... 13/2 P

[58] Field of Search ..... 13/2, 2 P, 9, 1, 31

[56] References Cited

U.S. PATENT DOCUMENTS

| | | | |
|---|---|---|---|
| 3,123,464 | 3/1964 | Casey et al. | 13/9 X |
| 3,422,206 | 1/1969 | Baker et al. | 13/2 UX |

*Primary Examiner*—R. N. Envall, Jr.

*Attorney, Agent, or Firm*—L. P. Johns

[57] ABSTRACT

A high temperature arc heater and reaction chamber for liquid state material processing and collection characterized by at least one arc heater connected tangentially to a circular reaction chamber where separation of liquid and gases occurs centrifugally and in which chamber an inner wall operates at relatively high temperature to limit the thickness of material buildup such as titanium or zirconium which solidifies on the wall.

10 Claims, 5 Drawing Figures

TITANIUM AND ZIRCONIUM PRODUCTION BY ARC HEATER

CROSS-REFERENCE TO RELATED APPLICATIONS

This application is related to the applications of Maurice G. Fey, Ser. No. 745,728, filed Nov. 26, 1976; Ser. No. 757,446, filed Jan. 6, 1977; and Francis J. Harvey, II, Ser. No. 757,545, filed Jan. 6, 1977.

BACKGROUND OF THE INVENTION

1. Field of the Invention

This invention relates to apparatus for the production of high temperature metals such as titanium and zirconium.

2. Description of the Prior Art

Arc heaters of prior construction are capable of heating gases to high temperatures for operation at high power levels. The high temperature gases are employed in industry to heat or react with other materials to cause new or modified compounds to be formed. The arc heater is particularly useful when the reaction temperatures must be high, and is also becoming increasingly important as a source of heat as the supply of hydrocarbon fuels diminishes.

The downstream sections or chambers of an arc heater are usually provided with water cooled walls, which in some processes are undesirable because condensation of product gases or solidification of fluids may occur and interfere with the particular process. Usually such an interference occurs due to either the removal of too much heat or the blockage to the passage of product materials due to the condensation or solidification of the materials.

SUMMARY OF THE INVENTION

To avoid the occurrence of the foregoing conditions and the concomitant problems associated therewith, a device is herein provided in accordance with this invention which comprises a high temperature reactor including a centrifugal reaction chamber having a peripheral wall and opposite side walls, an inner wall substantially concentric with the peripheral wall and extending over and spaced from the opposite side walls, at least one arc heater extending from the chamber and through the inner and outer peripheral walls, the arc heater having a downstream outlet directed tangentially into the chamber, first vent means for lighterweight products extending from the chamber, second vent means for heavier-weight product extending from the chamber, the first outlet means being located in one of the end walls, the inner wall including an opening aligned with the second vent means, the second vent means being located at the lowermost portion of the chamber, and the inner liner wall forming an opening extending into the second vent means.

The advantage of the device of this invention is that metallurgical problems normally associated with the handling and separation of high temperature materials is facilitated by the use of centrifugal separation of co-product metals and gases. The provision of an inner liner wall spaced from the outer wall is suitable for high power and high production rates in continuous operation and for the separation of liquids from gases, such as liquid titanium and zirconium from gaseous $MgCl_2$ or NaCl.

DESCRIPTION OF THE PREFERRED EMBODIMENTS

The process used herein is carried out as follows:

(A) providing an arc heater having spaced generally hollow, cylindrical electrodes forming an arc chamber communicating with a reaction chamber;

(B) striking an electric arc in an axial gap between the electrodes;

(C) introducing a gas selected from the group consisting of hydrogen and argon through the gap to provide an elongated arc stream;

(D) feeding into the arc heated gas stream a quantity of one element selected from the group consisting of an alkali metal and an alkaline-earth metal;

(E) feeding into the arc heated gas stream a quantity of a tetrahalide, such as a tetrachloride or tetrabromide, of a metal having a melting point higher than the boiling point of the co-product salt formed with the metal, the co-products being a liquid elemental metal and a gaseous salt;

(F) projecting the reaction products into the reaction chamber tangentially to cause the liquid elemental metal to separate centrifugally from the lighter gaseous salt; and (G) depositing the liquid elemental metal on the downwardly extending surface to permit the metal to flow into an associated receptacle.

Figure 1:
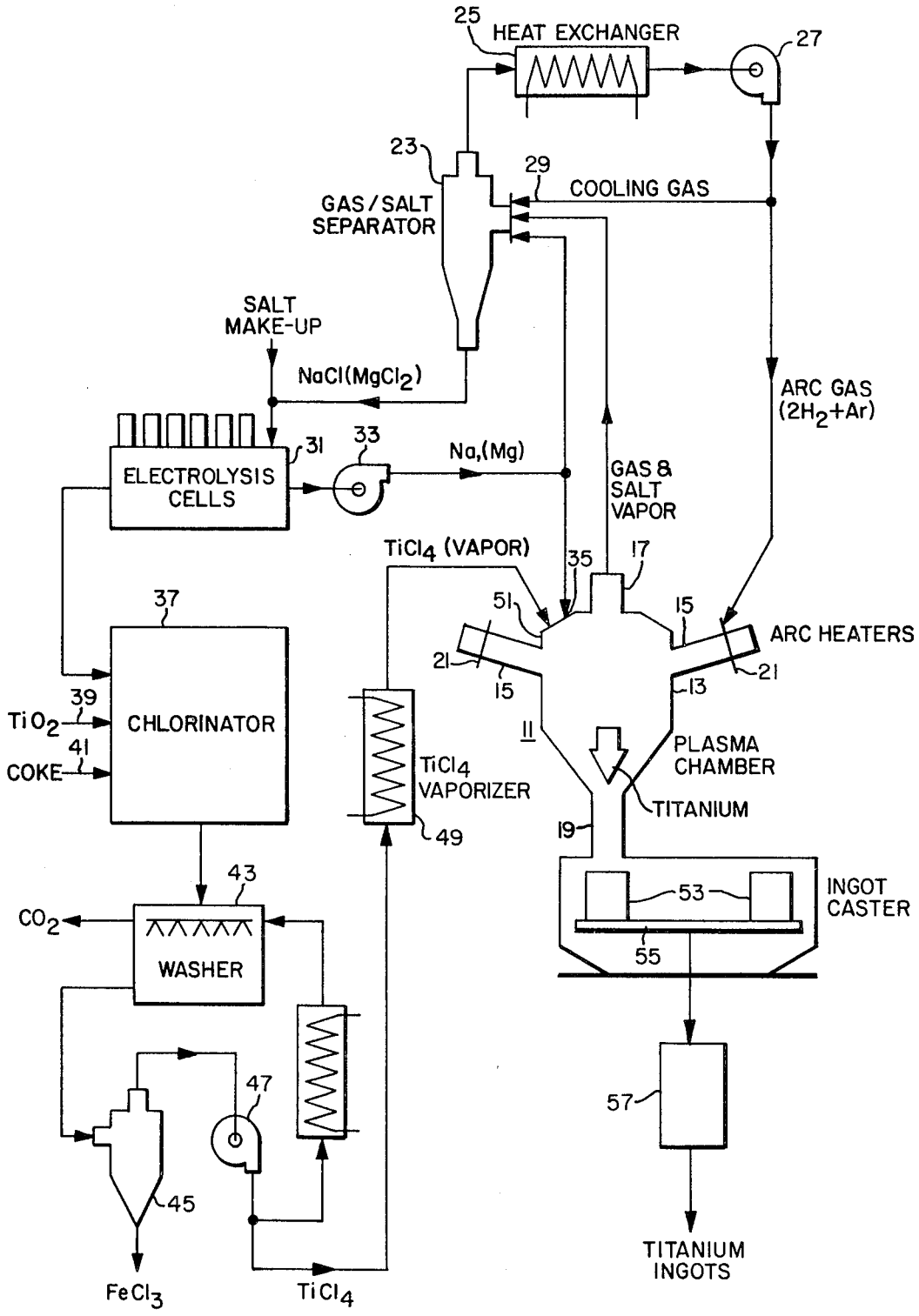
FIG. 1 is a flow diagram.

The process may be carried out in a reactor generally indicated at 11 in the drawings. The reactor 11 is supported by associated structures as shown in FIG. 1. The reactor 11 comprises a circular chamber 13, at least one and preferably a plurality of arc heaters 15, a first vent or outlet means 17 for co-product gases, and second vent or outlet means 19 for the primary product, namely, elemental metal such as titanium.

Arc gas is introduced into the system at 21 through the arc heaters 15 as will be set forth more particularly below. The gas together with the lighter co-products including salt vapor leave the reactor through the outlet means 17 and are connected to a cyclone-type separator 23 for separating the gas and salt, the former of which is transmitted to a heat exchanger 25 for reheating and redirected by a pump 27 into the arc heaters at inlet 21. Cooling gas may be introduced at inlet 29 of the separator. The salt vapor leaves the lower end of the separator 23 from where it is conducted to at electrolysis cell 31 for disassociating the salts into their primary elements such as sodium or magnesium and chlorine or bromine.

The metal sodium or magnesium is transmitted by a pump 33 to an inlet 35 where it is introduced into the reactor. The resulting chlorine from the cell 31 is conducted to a chlorinator 37 where, together with a metal oxide, such as titanium dioxide, introduced at inlet 39 and a carbonaceous material, such as coke, introduced at inlet 41 react with the chlorine to produce a metal tetrachloride, such at titanium tetrachloride ($TiCl_4$), and carbon dioxide which are directed to a washer 43 for separation. The metal tetrachloride proceeds through a cyclone separator 45 for removal of any foreign materials such as $FeCl_3$, from where the tetrachloride is moved by a pump 47 to a vaporizer 49 and then to the reactor 11 at an inlet 51.

The end product is an elemental metal, such as titanium, which drops through the outlet means 19 into a mold 53 which, as shown in FIG. 1, is one of a plurality of similar molds placed upon a rotatable platform 55 by which a plurality of similar molds 53 may be filled. Thereafter, optionally ingots may be removed from the mold 53 and subjected to a remelting stage 57 to further refine the metal such as by degassing.

Figure 2:
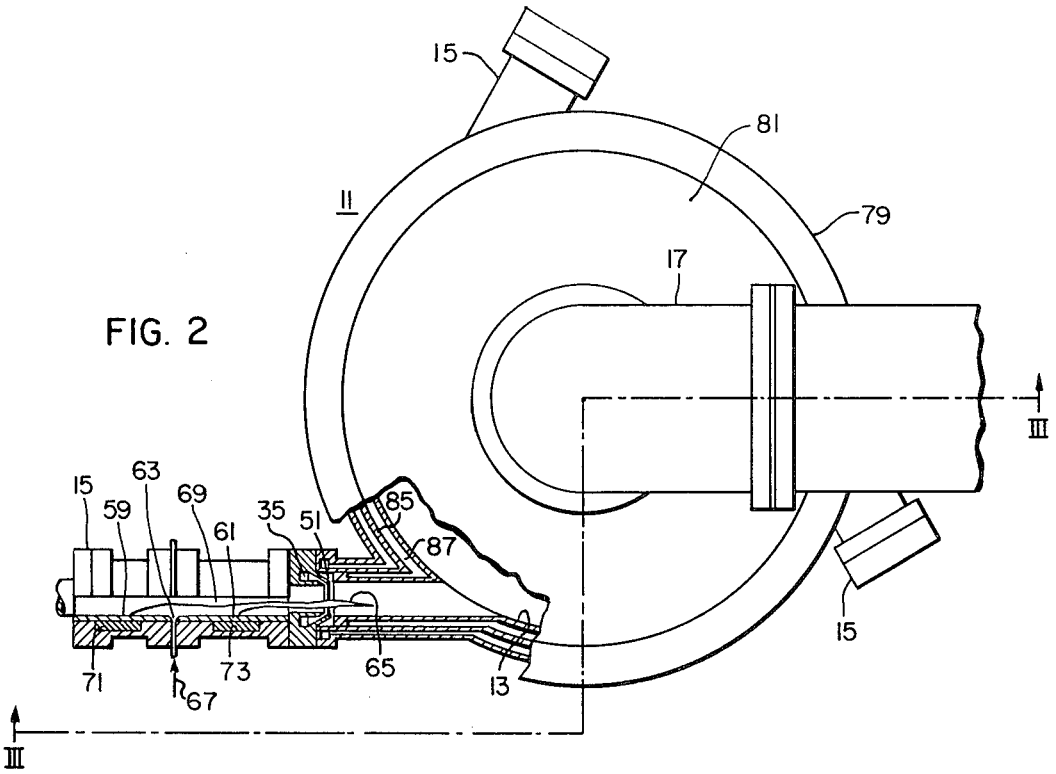
FIG. 2 is a plan view, partly in section, of the reactor having three arc heaters.

As shown in FIG. 2, one or more and preferably three arc heaters 15 are similar in construction and operation to that disclosed in U.S. Pat. No. 3,765,870. entitled "Method of Direct Ore Reduction Using A Short Gap Arc Heater" of which the inventors are M. G. Fey and George A Kenny. Because of the full disclosure in that patent, the description of the arc heaters 15 is limited herein to the basic structure and operation. The arc heaters 15 are each a single phase, self-stabilizing AC device capable of power levels up to about 3500 kilowatts, or up to about 10,000 kilowatts for a three phase plant installation. In the practice of this invention, it is preferred that three arc heaters be provided, one for each of the three phases of the AC power supply. As shown in FIG. 2, the arc heater 15 has two annular copper electrodes 59, 61 which are spaced at 63 about 1 millimeter apart to accommodate a line frequency power source of about 4 kV. An arc 65 occurs in the space or gap 63 and incoming feed stock gas immediately blows the arc 65 from the space into the interior of the arc chamber 69. The feed stock gas 67 must be compatible with the particular metal being reduced in the reactor 11 and may be one of the gases selected from the group consisting of argon, helium, hydrogen, and carbon monoxide, or mixtures thereof. The arc 65 rotates at a speed of about 1000 revolutions per second by interaction of the arc current (several thousand amps AC) with a DC magnetic field set up by internally mounted field coils 71, 73. The velocities yield a very high operating efficiency for equipment of this type and the elongated arc 65 is ultimately projected by the gas downstream toward and possibly into the reaction chamber 13.

Feed stock material is introduced through inlet ports 35, 51, preferably downstream of the electrodes 61 so that the materials do not interfere with the operation of the arc heater.

The reacting materials are tetrachloride salts of the particular metal to be produced such as titanium, hafnium, and zirconium. The other reactant is a metal of the alkali or alkaline-earth metals, such as sodium or magnesium, the latter of which is preferred for economic reasons. The metal salt however is not limited to tetrachloride, but may include any halide such as tetrabromides. When introduced into the downstream arc zone, the materials introduced through the inlet ports 35, 51 react substantially as shown in the following formulas:

$$TiCl_4 + 4Na \rightarrow Ti + 4NaCl \uparrow \quad (1)$$

$$ZrCl_4 + 2Mg \rightarrow Zr + 2MgCl_2 \uparrow \quad (2)$$

$$HfBr_4 + 2Mg \rightarrow Hf + 2MgBr_2 \uparrow \quad (3)$$

The foregoing formulas are exemplary of the possibilities available for producing the respective metals. It is understood that titanium, zirconium, or hafnium may be introduced as either a chloride or bromide which in turn is reacted with either sodium or magnesium to produce the products indicated in the formulas (1), (2), (3). For the foregoing reactions to successfully produce the desired product metal, a metal must have a melting point greater than the boiling point of the co-product salt, whereby they are subsequently separated with the metal in the liquid state and the salt in the gaseous state. The minimum reaction temperature for the foregoing formulas must be above the boiling point of either of the salts, that is, the chloride or bromide of sodium or magnesium. The maximum temperature being 3500° K (3227° C). In the following table, a list of the melting points for the elements titanium, zirconium, and hafnium and the boiling points for the several compounds or salts are listed.

TABLE

| Element | Melting Point | Compound | Boiling Point |
|---|---|---|---|
| Titanium | 1800° C | NaBr | 1390° C |
| Zirconium | 1857° C | $MgCl_2$ | 1412° C |
| Hafnium | 1700° C | NaCl | 1413° C |
| | | $MgBr_2$ | 1284° C |

Accordingly, so long as the resulting metal has a melting point above the boiling point of the resulting compound or salt, the reaction will proceed.

Figure 3:
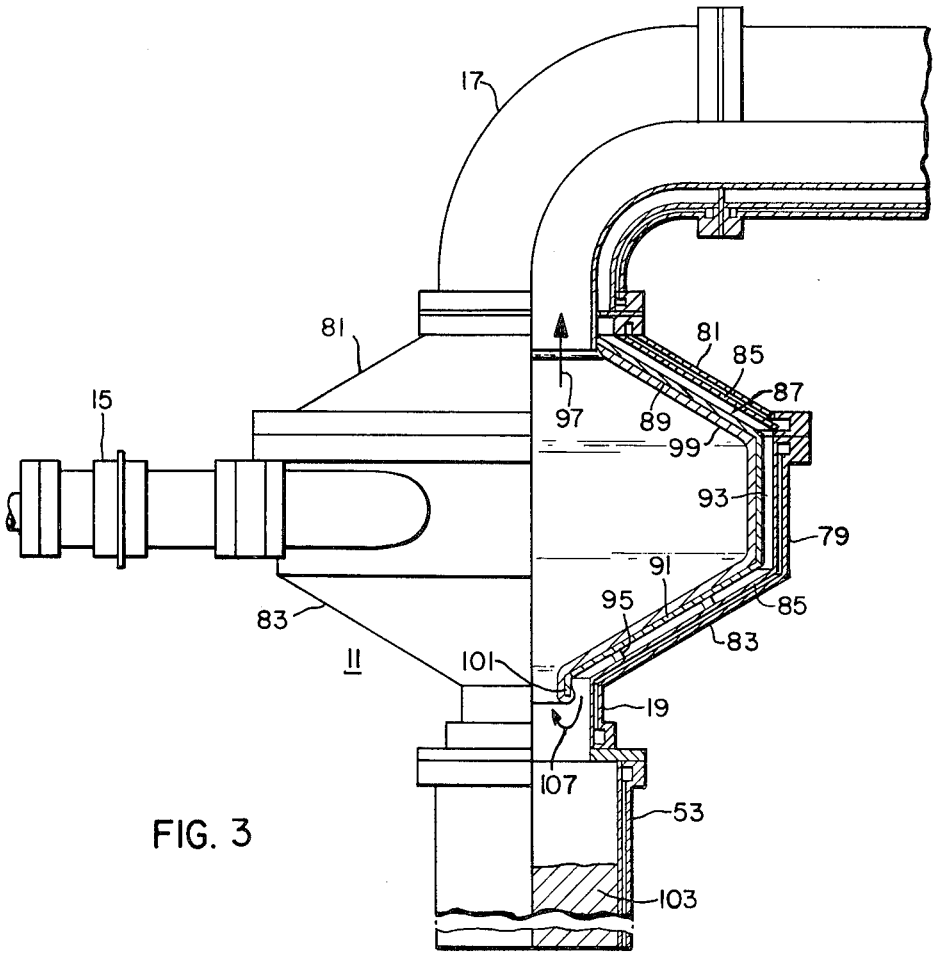
FIG. 3 is a vertical view taken on the line III—III of FIG. 2.

As shown in FIGS. 2 and 3, the arc heaters 15 are connected to the centrifugal or plasma chamber 13 tangentially. The chamber 13 is preferably cylindrical (FIG. 3) to enhance centrifugal separation of the light and heavy co-products of the foregoing reactions, whereby the lighter, gaseous salt products leave the reactor 11 via the outlet means 17 and the heavier metal exit through the outlet means 19.

The chamber 13 is contained between a peripheral wall 79 and opposite end walls 81, 83. The upper end wall 81 is preferably tapered upwardly from the peripheral wall 79 and joins the lower end of the outlet means 17 so that the co-product gases are more readily directed from the centrifugal zone within the chamber 13 towards the outlet means 17. Similarly, the lower end wall 83 is inclined downwardly, and as shown in the embodiment of FIG. 3, joins the outlet means 19 which communicates with the ingot mold or collection chamber 53 for the molten metal formed during the reaction. More particularly, the peripheral wall 79 and end walls 81, 83 are preferably cooled by water jacket means 85 of a conventional nature.

Moreover, in accordance with this invention, the chamber 13 comprises an inner wall or liner 87 which is substantially concentrically disposed and spaced from the peripheral wall 79 and the end walls 81, 83. The inner wall 87 preferably comprises upwardly and inwardly inclined upper wall portion 89 and a lower wall portion 91. The spacing 93 between the peripheral and end walls 79, 81, 83 and the inner walls 87, 89, 91 is maintained in a suitable manner such as by spaced ceramic support rings 95 (FIG.3).

The inner wall means including the walls 87, 89, 91 are provided to operate at high wall temperatures where a liquid product such as titanium, zirconium, and hafnium, is the product of the reaction within the chamber 13. As the liquid metal separates centrifugally from the cool product gas which leaves the reaction chamber 13 through the outlet as indicated by the arrow 97, the liquid metal deposits on the inner walls 87, 89, 91 to form a solidified metal layer 97 having a thickness which is established by heat transfer equilibrium which thickness is normally limited to less than two inches. In view of the high temperature involved within the chamber 13, the inner walls 87, 89, 91 are composed of a high temperature material such as tantalum or tungsten. The inner walls 87, 89, 91 are cooled by radiation to the water cooled outer walls 79, 81, 83.

Inasmuch as the heat transfer from the inner walls 87, 89, 91 to the outer cooled walls 79, 81, 83 is critical to the operation of the reactor 11, certain product materials or metals have different thermal properties or coefficients of heat transfer which require additional control means for preventing heat excape from the chamber too rapidly. Where a metal layer 97 has a relatively high coefficient of thermal conductivity, an interior layer 99 of a ceramic material, such as MgO, is provided in a thickness sufficient to delay ultimate transfer of heat to the water coold peripheral wall. The thickness of the solidified metal layer 97 is dependent upon a temperature gradient through the layer as well as the thermal equilibrium status within the chamber including the zone between inner wall 87 and the peripheral wall 79. Accordingly, the surface of the metal layer 97 farthest from the inner wall 87 remains liquid and runs down the metal layer surface and exits at the lower end thereof into the ingot mold 53. For that purpose, the lower end of the inner wall 91 is preferably provided with a flange or drip portion 101 extending into the outlet means 19, thereby preventing the molten metal product from depositing on or contacting the walls forming the outlet means 19. Thus, a metal ingot 103 forms in the ingot mold 53.

Figure 5:
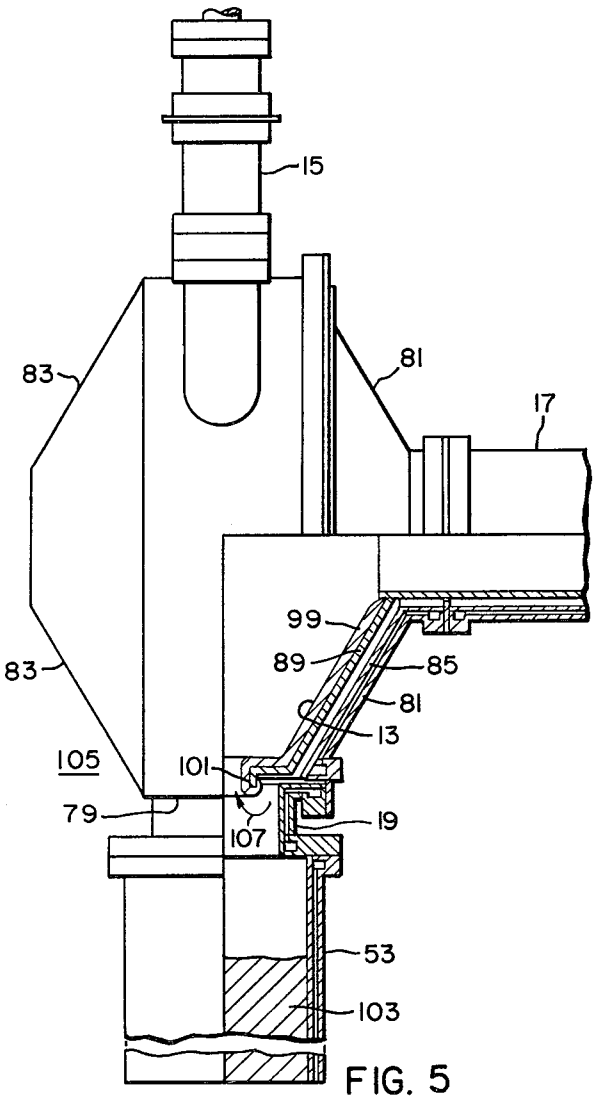
FIG. 5 is an elevational view, partly in section, taken on the line V—V of FIG. 4.
Figure 4:
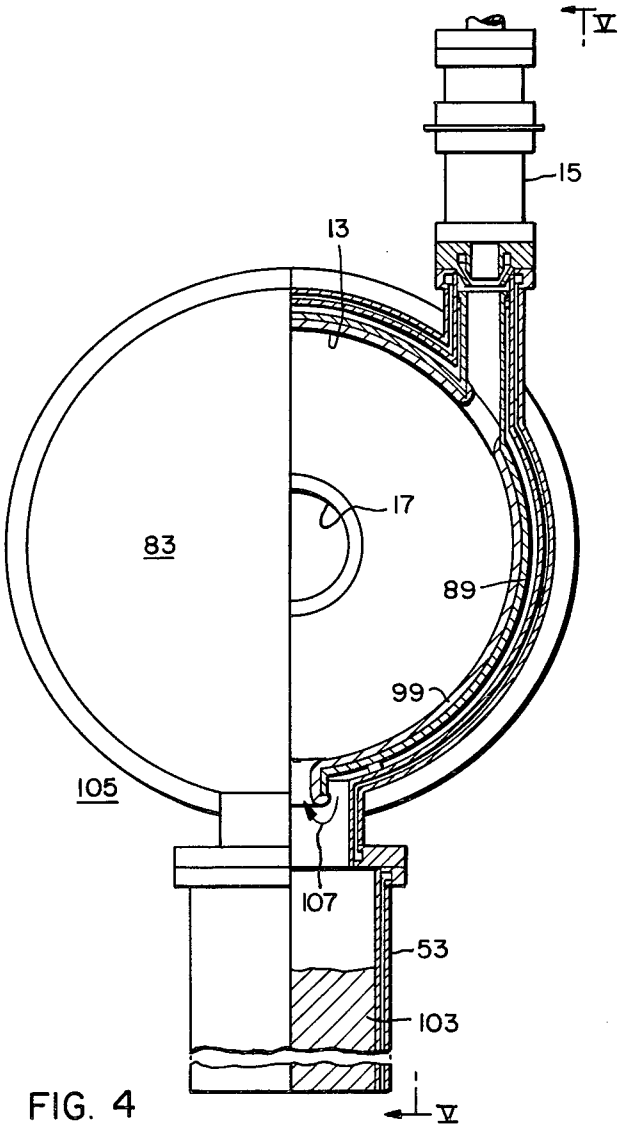
FIG. 4 is an elevational view, partly in section, of another embodiment of the invention.

Another embodiment of the invention is shown in FIGS. 4 and 5 in which a reactor generally indicated at 105 comprises parts with reference numbers similar to those of the reactor 11 (FIGS. 2 and 3). More particularly, the reactor 105 (FIGS. 4 and 5) is disposed on a different axis so that the lowermost part of the reactor 105 is a portion of the peripheral wall 79 where the outlet means 19 is disposed for accumulating the downwardly flowing liquid metal as it accumulates at the metal layer 99. The gas outlet means 17 is disposed in the end wall 81 similar to that of the reactor 11. In all other respects the reactor 105 has similar structural and operational features as those of the reactor 11.

Where the reactant contains oxidizing agents, the liners 87, 89, 91 should be composed of a refractory material instead of a metal such as tantalum and tungsten. In addition, the exterior of the liner 89 should be blanketed by an inert gas to prevent oxidation. Furthermore, the inert gas should be circulated as shown by the arrow 107 to prevent the entrance of any undesirable materials such as magnesium chloride into the casting chamber of the mold 53.

In addition, some processes do not require a vortex separation of material, but could benefit from the application of downstream sections constructed in a similar manner as for instance, the exhaust connection to the vortex chamber. Such construction would in many cases reduce the overall heat transfer to the water cooled walls, and promote more uniform temperatures throughout the mixture and there would be less tendency for condensation to take place on the walls. That type of construction could be very useful where a long resonance time in a heated gas is required as in the processing of powdered materials.

The following example is exemplary of the process of this invention.

EXAMPLE

As shown in FIG. 1, titania and coke are reacted with chlorine to produce $TiCl_4$, $CO_2$, and traces of $FeCL_3$, which are separated by filtering. The $TiCl_4$ is condensed in washer 43 and gaseous $CO_2$ is then removed. After being vaporized, the purified $TiCl_4$ gas is injected into the plasma reactor chamber 13. A liquid alkali metal, sodium or magnesium, is atomized and simultaneously injected into the reactor chamber, which is maintained at the reaction temperature of 2200° K by an arc heated stream of 0.67 moles of hydrogen and 0.33 moles of argon, preheated to an energy level of 12,000 BTU per pound. As the titanium is formed in the liquid state (m.p. = 1998° K), the alkali salt leaves the reactor as a vapor (b.p. = 1686° K for NaCl and 1685° K for $MgCl_2$) along with the arc-heated hydrogen-argon mixture, which is used merely as a heat transfer agent. The arc heated reduction unit is a cyclonic separation device with a strong vortex used to induce the fine droplets of elemental titanium to deposit the run down the wall, while the vaporized salt exits through the top center along with the hydrogen-argon stream. The walls of the cyclone unit are an equilibrium layer of titanium, molten on the inside, and water or radiation cooled on the outside. The titanium is then cast into ingot form.

After leaving the plasma reduction unit, the metal chloride vapor and heat tranfer gases are cooled below the chloride dew point by admixture of liquid metal and cold hydrogen-argon. The metal salt is then collected in a molten wall cyclone. The salt is then separated electrolytically in existing technology cells and the alkali metal and chlorine are circulated to their respective loops in the process. The hydrogen-argon mixture is cleaned, cooled, compressed, and recirculated to the arc heaters.

A preliminary estimate of energy and mass flow requirements was made for titanium production when using either sodium or magnesium as the reducing agent. The Table II below represents the requirements for the production of 50,000 tons per year.

TABLE II

| Plasma Reactor: | Sodium Reduction | Magnesium Reduction |
|---|---|---|
| Input: $TiCl_4$ (tons per year) | 197,840 | 197,840 |
| Alkali Metal (tons per year) | 95,992 | 50,741 |
| Arc Gas ($H_2$ + Ar) (tons per year) | 31,609 | 21,379 |
| Output: Ti (tons per year) | 50,000 | 50,000 |
| Salt (tons per year) | 244,008 | 198,770 |
| Gas ($H_2$ − Ar) (tons per year) | 31,609 | 21,379 |
| Power Requirements: | | |
| Arc Power KW | 37,045 | 25,055 |
| Salt Regeneration KW | 179,984 | 114,168 |

The use of magnesium as a reducing agent appears to be the most economical approach. A preliminary estimate of total production costs including capital investment requirements indicates that titanium could be produced by this process at a cost of 30 to 40 cents per pound. Titanium currently sells for $5.00 and above per pound.

Accordingly, the reactor of the present invention provides for a unique assembly of an arc heater and reaction chamber which is suitable for either single phase or three phase operation, i.e. for one or three arc heaters the latter of which has three phases. Such an assembly is also suitable for high power and high production rates in continuous operation. Finally, an arc heater and reaction chamber design which in the case of exothermic reaction, provides the utilization of at least part of heat reaction in promoting reaction.

What is claimed is:

1. A high temperature reactor comprising a centrifugal chamber having a peripheral wall and opposite end walls, an inner wall substantially concentric with the peripheral wall and extending over and spaced from the opposite end walls, at least one arc heater extending from the chamber and through the inner and peripheral walls, the arc heater having a downstream outlet directed tangentially into the centrifugal chamber, the arc heater comprising a pair of axially spaced substantially cylindrical electrodes forming a narrow gap therebetween and adopted to be connected to a source of potential to produce an arc therebetween, the electrodes forming an arc chamber that communicates with the centrifugal chamber, gas inlet means communicating with the gap for introducing a non-conductive reducing gas into the arc chamber to form an arc heated gas stream, second inlet means communicating with the downstream outlet for introducing a quantity of a tetrahalide of a metal into the gas stream, third inlet means for introducing into the gas stream a quantity of one element selected from the group consisting of an alkali metal and an alkaline-earth metal, first vent means for lighter-weight products extending from the centrifugal chamber, and second vent means for heavier-weight products extending from the centrifugal chamber.

2. The reactor of claim 1 in which the first outlet means is located in one of the end walls.

3. The reactor of claim 2 in which three arc heaters are disposed at substantially equally spaced positions.

4. The reactor of claim 3 in which the inner wall includes an opening aligned with the second vent means.

5. The reactor of claim 4 in which the second vent means is located at the lowermost portion of the chamber.

6. The reactor of claim 5 in which the inner liner wall forming the opening extends into the second vent means.

7. The reactor of claim 4 in which the second vent means is located in one end wall.

8. The reactor of claim 7 in which the first vent means is located in the other end wall.

9. The reactor of claim 2 in which the first vent means is located in the peripheral wall.

10. The reactor of claim 5 in which a receptacle is located below the second vent means.

* * * * *